US009603460B2

(12) United States Patent
DeFranks et al.

(10) Patent No.: US 9,603,460 B2
(45) Date of Patent: Mar. 28, 2017

(54) SYSTEMS AND METHODS FOR MANUFACTURING SPRINGS WITH FOAM CHARACTERISTICS

(75) Inventors: Michael S. DeFranks, Decatur, GA (US); Rahul Kirtikar, Atlanta, GA (US)

(73) Assignee: DREAMWELL, LTD., Las Vegas, NV (US)

( * ) Notice: Subject to any disclaimer, the term of this patent is extended or adjusted under 35 U.S.C. 154(b) by 966 days.

(21) Appl. No.: 12/806,723

(22) Filed: Aug. 19, 2010

(65) Prior Publication Data

US 2011/0041252 A1 Feb. 24, 2011

Related U.S. Application Data

(60) Provisional application No. 61/274,602, filed on Aug. 19, 2009.

(51) Int. Cl.
*A47C 16/00* (2006.01)
*A47C 27/06* (2006.01)

(52) U.S. Cl.
CPC ..... *A47C 27/064* (2013.01); *Y10T 29/481* (2015.01)

(58) Field of Classification Search
USPC .... 5/716, 718, 720, 721, 936, 698, 699, 954
See application file for complete search history.

(56) References Cited

U.S. PATENT DOCUMENTS

| | | | | |
|---|---|---|---|---|
| 3,916,464 | A | 11/1975 | Tyhanic | |
| 5,868,383 | A | 2/1999 | Codos | |
| 6,826,796 | B1 | 12/2004 | Mossbeck | |
| 6,898,813 | B2 * | 5/2005 | Grothaus | 5/655.8 |
| 6,966,091 | B2 * | 11/2005 | Barber | 5/716 |
| 2004/0128773 | A1 | 7/2004 | Barber | |
| 2005/0257883 | A1 | 11/2005 | Anagnostopoulos | |
| 2006/0075567 | A1 * | 4/2006 | DeFranks | 5/699 |

FOREIGN PATENT DOCUMENTS

| | | | |
|---|---|---|---|
| DE | 29722598 | U1 | 2/1998 |
| GB | 2403902 | A | 1/2005 |

OTHER PUBLICATIONS

International Search Report for International Application No. PCT/US2010/002275 mailed Nov. 12, 2010.
International Preliminary Report on Patentability issued in International Application No. PCT/US2010/002275 dated Mar. 1, 2012; 5 pages.

* cited by examiner

*Primary Examiner* — Richard G Davis
(74) *Attorney, Agent, or Firm* — Cantor Colburn LLP

(57) ABSTRACT

Systems and methods include a spring-coil assembly having non-linear load-deflection characteristics that are substantially similar to foam. In particular, the systems and methods described herein include a first set of encased springs that are in a partially compressed state and a second set of shorter springs. These two sets of springs may be arranged in alternating rows such that the resulting spring-coil assembly displays non-linear load-deflection characteristics similar to foam.

15 Claims, 13 Drawing Sheets

SYSTEMS AND METHODS FOR MANUFACTURING SPRINGS WITH FOAM CHARACTERISTICS

CROSS-REFERENCE TO RELATED APPLICATIONS

This application claims priority to and the benefit of U.S. Provisional Patent Application Ser. No. 61/274,602, filed Aug. 19, 2009 and entitled "Systems and Methods for Manufacturing Springs with Foam Characteristics", the entire contents of which are incorporated herein by reference.

FIELD OF THE INVENTION

The systems and methods described relate to cushioning articles with springs, and more specifically, mattress assemblies with springs configured to provide the compressive behavior of foam.

BACKGROUND

Many mattresses incorporate springs into the mattress innercore to provide mattress resiliency. At the same time, foam mattresses are becoming more popular with a certain set of mattress consumers because their compressive properties differ significantly from standard spring-based innercore mattresses. The mechanical deflection properties of foam are complex. These properties depend upon the geometry of the cells that make up the foam and the properties of the polymer making up the foams structural elements. Cell size and polymer density also play a role. Further complicating the response is that elements of the foam that effect its mechanical response can vary depending as a function of applied load. Thus, foam, such as polyurethane foam, typically has a non-linear deflection response, that is dependent on the particular characteristics of the foam. One example of a deflection response for a foam block is presented in FIG. 7.3 of Dow Polyurethanes. Flexible Foams, Herrington et al., Dow Chemical Company, 2nd Edition (1997). This figure illustrates the complex deflection response mechanics provided by foam cores.

Steel coil springs of conventional symmetric helical design have a well know linear spring response. Non-linear spring coils are also known that have non-linear responses to applied loads, by having coils of progressively smaller radius that present varying response to a load of increasing force. However, non-linear springs lack the complex dynamic response of a cellular foam block.

Accordingly, there remains a need in the art for a spring inner-core that provides a deflection response that is comparable to the response of foam. Therefore, a method for providing the compressive properties of foam with a spring-based mattress or innercore is desirable.

SUMMARY

It is a realization of the systems and methods described herein that improved spring-based mattress assemblies can provide improved mattresses that substantially mimic the compressive properties of foam. Though not to be bound by theory, this realization arises in part from the comparison of the load-deflection characteristics of foam and springs, which is a measurement of the load bearing properties of the material. Traditional springs display linear load-deflection characteristics, which means springs compress by an amount that is linearly proportional to the load or force applied to them. When a user sleeps on the surface of the mattress, he/she applies a weight on the underlying springs, which in turn compress to provide adequate cushioning support. As a consequence of its linear load-deflection properties, lighter users apply less weight on the springs, causing these springs to compress less and thereby providing a different feel to what a heavier person would experience. Thus, lighter users might experience a different level of comfort as compared to heavier users for a given set of springs. This may present a problem when two sleeping partners are of significantly different weights, for example 120 lbs and 220 lbs. In such cases, one mattress is unlikely to be comfortable for both partners. Foam alleviates this problem because, unlike a spring, it is a cellular polymeric material that displays non-linear load-deflection characteristics. However, as noted above, foam mattresses are significantly more expensive and difficult to manufacture than spring mattresses. The systems and methods described herein include a spring-coil assembly having non-linear load-deflection characteristics that are substantially similar to foam. In particular, the systems and methods described herein include a first set of encased springs that are in a partially compressed state and a second set of shorter springs, that may also optionally be encased. These two sets of springs may be arranged in alternating rows such that the resulting spring-coil assembly displays non-linear load-deflection characteristics similar to foam.

The systems and methods described herein are directed to cushioning articles with springs configured to provide foam-like compressive behavior. For purposes of clarity, and not by way of limitation, the systems and methods may be described herein in the context of mattress assemblies with springs configured to provide foam-like compressive behavior. However, it may be understood that the systems and methods described herein may be applied to provide for any type of cushioning article. For example, the systems and methods of the invention may be used for seat cushions, pillows, and other such cushioning articles.

In one aspect, the systems and methods described herein include a cushion construction having a spring coil assembly configured to mimic the compression characteristics of foam. The spring coil assembly may include a plurality of rows of a first set of encased springs, wherein each spring of the first set of springs is in a partially compressed state within an encasement, which may include a fabric casing. The spring coil assembly may also include a plurality of rows of a second set of springs, wherein each row of the second set of springs is positioned between the rows of the first set of encased springs. In certain optional embodiments, the rows of the first set of springs and the rows of the second set of springs are arranged in alternating rows. The second set of springs may have a free length less than a free length or encased height of springs in the first set of encased springs.

In certain embodiments, the free length of each spring in the first set may be from about 7.25 inches to about 13.25 inches, and the free length of each spring in the second set of springs may be from about 1 inch to about 8 inches. The height of the encasement may be from about 2 inches to about 10 inches. Generally, the difference between the free length of the spring in the first set of springs and a height of the encasement determines the amount of compression each spring in the first set of springs is under while in the partially compressed state.

In certain illustrative, but not limiting, embodiments, the spring rate of the first set of springs is less than the spring rate of the second set of springs. For example, the spring rate of the first set of springs may be from about 0.39 lbf/in. to about 2.47 lbf/in, and the spring rate of the second set of springs may be from about 2.55 lbf/in. to about 12.36 lbf/in. However, the spring rates selected will depend on the desired deflection response, and will be selected, at least in part, to mimic the dynamic response of the foam core response desired. In certain other example embodiments, at least one of the springs in the first set and second set comprise one or more types of spring coils from the group consisting of open spring coils, encased spring coils, conical coils and asymmetrical spring coils.

In certain other embodiments, each spring of the second set of springs is in a partially compressed state and disposed within an encasement. Each spring of the second set of springs may be in contact with the encasement surrounding four springs of the first set of springs, and vice versa. In certain embodiments, the alternating rows of the first set and the second set are arranged in an offset manner, such that each row of the second set of springs fits in a gap between two rows of the first set of springs.

The cushion construction may further comprise a padding layer disposed on at least one surface of the spring coil assembly, wherein the padding layer may have variable thickness such that the thickness of the padding layer, or layers, at a particular location, complements the height of the spring at that location and sits against the top of that spring. In certain embodiments, the cushion construction includes one or more fire-retardant, liquid-resistant, or allergy resistant layers disposed on at least one surface of the spring coil assembly.

In another aspect, the systems and methods described herein include methods of manufacturing a spring coil assembly. The methods may include providing a first set of springs and a second set of springs, wherein a free length of the first set of springs is greater than a free length of the second set of springs. The method may further include partially compressing the first set of springs and disposing them in an encasement while in the partially compressed state. The first set of encased springs and the second set of springs may be arranged in alternating rows. The spring coil assembly may have non-linear load-deflection characteristics based on one or more parameters of the first set of springs, the second set of springs, amount of compression of the first set of springs, and arrangement of the alternating rows.

BRIEF DESCRIPTION OF THE FIGURES

The foregoing and other objects and advantages of the invention will be appreciated more fully from the following further description thereof, with reference to the accompanying drawings wherein.

DETAILED DESCRIPTION OF THE ILLUSTRATIVE EMBODIMENTS

To provide an overall understanding of the invention, certain illustrative embodiments will now be described, including a mattress assembly with springs configured to provide foam-like compressive behavior. However, it will be understood by one of ordinary skill in the art that the systems and methods described herein may be adapted and modified for other suitable applications and that such other additions and modifications will not depart from the scope thereof.

Figure 1:
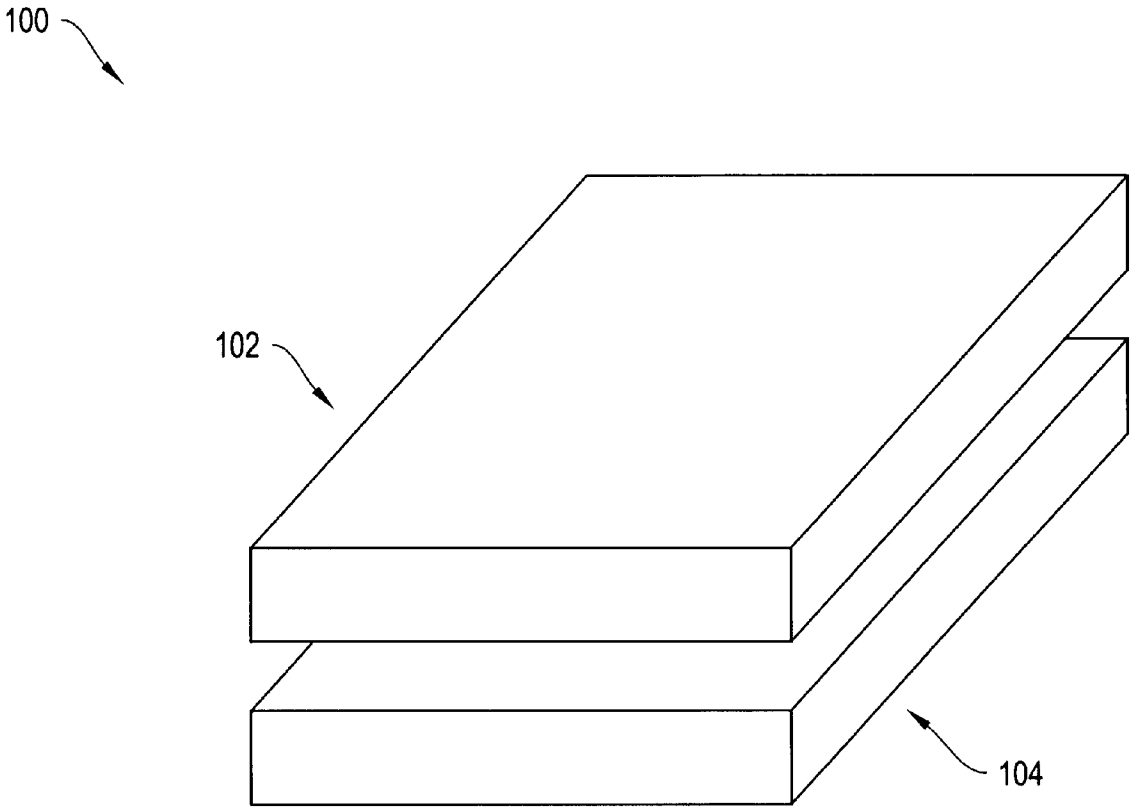
FIG. 1 depicts a mattress assembly, according to an illustrative embodiment of the invention.

In many aspects, the systems and methods described herein provide a spring mattress assembly providing foam-like compressive behavior. FIG. 1 depicts an illustrative embodiment of a typical mattress assembly 100. Mattress assembly 100 may include a mattress 102 and an optional foundation 104. Mattress 102 includes an innercore (not shown) that may include a spring-coil assembly having springs, such as coil springs or encased coil springs arranged in an array. The spring-coil assembly may be configured to provide foam-like compressive behavior, as will be described in more detail with reference to FIGS. 2-12. Briefly, the spring-coil assembly may include a first set of encased springs that are in a partially compressed state and a second set of shorter springs, that may also optionally be encased. These two sets of springs may be arranged in alternating rows such that the resulting spring-coil assembly displays non-linear load-deflection characteristics similar to foam. In certain embodiments, the innercore may also include other support structures and materials, such as foam, latex, gel, viscoelastic gel, or a combination of the foregoing, in one or more layers. The innercore may have a firmness that varies across its length and width. Foundation 104 may include a conventional foundation, a box spring, a platform or any other suitable foundation. The mattress frame may be adjustable, allowing the frame and/or mattress to pivot or bend along one or more pivoting axes.

In certain embodiments, mattress 102 may also include one or more side rails (not shown). Side rails may be attached or placed adjacent to one or more sides of the inner core, and may include springs, spring coils, encased spring coils, foam, latex, gel, viscoelastic gel, or a combination of the foregoing, in one or more layers. Side rails may be placed on one side of the innercore, opposing sides of the innercore, on three adjacent sides of the innercore, or on all four sides of the innercore. In some mattress embodiments, the innercore may not include springs, and the side rails may include springs, and in some embodiments, these springs may be configured to provide foam-like compressive behavior. In certain embodiments, the side rails may include edge supports with firmness comparable to or greater than the firmness of the innercore. The side rails may be fastened to the innercore via adhesives, mechanical fasteners, or any other methods for attachment.

Optionally, mattress 102 may include a padding layer. The padding layer may be adjacent to the top surface of the innercore or the bottom surface of the innercore. In some embodiments, mattress 102 may be a reversible mattress, in which both the top surface and bottom surface provide padded sleeping surfaces. Optionally, the mattress may be one-sided. In other embodiments, there may be a padding layer adjacent to the top surface and another padding layer adjacent to the bottom surface of the innercore. The padding layer may include foam, gel, or any other type of padding material, in one or more layers. In some embodiments, mattress 102 may include a topper pad that may define the top exterior surface of the mattress. This topper pad may include foam gel, or any other type of suitable padding material, in one or more layers. In certain embodiments, the topper pad and/or the padding layer is made of quiltable material. Typically, the topper pad may have a uniform height or thickness along its width and length, or its height or thickness may vary along at least one of the width and length. For example, the topper pad may be thicker in the center than at its periphery. In some embodiments, such as for a reversible mattress, a second topper pad may define the bottom exterior surface of the mattress.

In further alternative embodiments, the mattress 102 may include one or more fire-retardant, liquid-resistant, or allergy-resistant layers. One or more of these layers may be placed adjacent to the innercore on its top surface, bottom surface, and/or one or more side surfaces. In some embodiments, one or more of these layers may be placed adjacent to a surface of a padding layer or a topper pad in the mattress 102. The fire-retardant layers may comprise a fire barrier fabric or laminate that complies with regulatory requirements for flammability, such as the 16 CFR Flammable Fabrics Acts Regulations or California Bureau of Home Furnishings Technical Bulletin 129 Flammability Test Procedure, the entirety of which is hereby incorporated be reference. In certain embodiments, the fire-retardant layer may be quiltable. The one or more liquid-resistant or allergy-resistant layers may comprise a coated or uncoated fabric or laminate material. The liquid-resistant or allergy-resistant layer may be breathable and quiltable.

The various layers detailed above may be fastened to each other in a number of ways. For example, layers may be attached to each other along the edges, in the center, between the edges and the center, or some combination of the above. Attachment may be done via stitching, quilting, adhesives, or fastening via mechanical fasteners.

Figure 2:
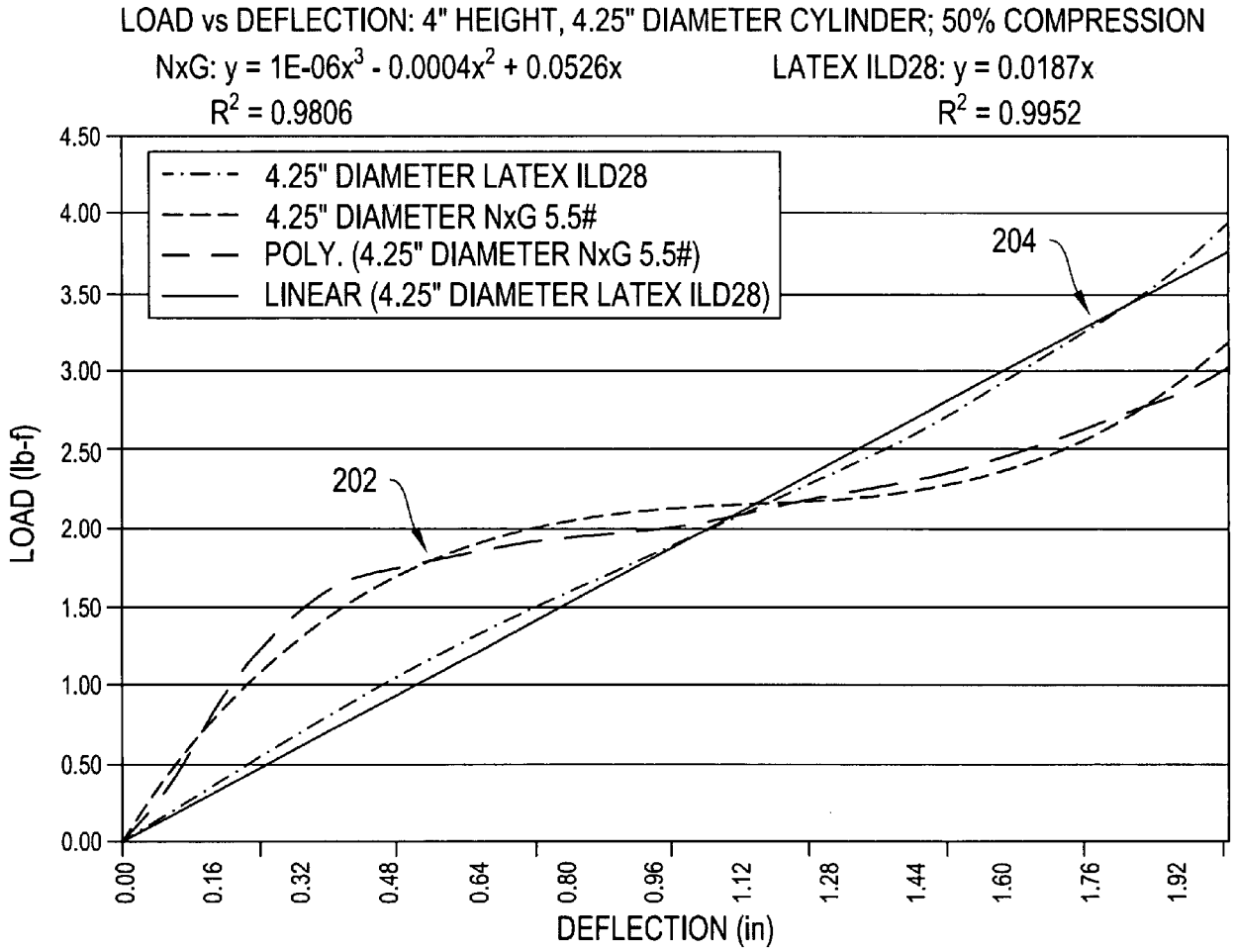
FIG. 2 is a graph comparing the compressive behavior of example foam layers and springs.

FIG. 2 is a graph comparing the compressive behavior of foam and coil springs. Material compressive behavior may be characterized in terms of a force versus deflection curve. Curve 202 is an example of a force versus deflection (or load-deflection) curve for a foam layer, whereas curve 204 is an example of a force versus deflection curve for a traditional coil spring. An open, unencased spring coil may have a linear load-deflection curve, as curve 204 demonstrates. Variations in the physical properties of a spring coil may change the characteristics of its load-deflection curve. For example, a spring with an asymmetric shape (e.g., larger coil diameter at one end of the spring versus the other end of the spring, or different coil pitches at either end) may not have a fully linear load-deflection curve. In contrast, curve 202 is an example of a load-deflection curve for a foam layer, which is often nonlinear. In this example, the nonlinear foam layer load-deflection curve displays a changing rate of curvature, with curvature changing less quickly (i.e. slope becomes less steep as the independent variable [deflection] increases) for a first deflection range (e.g., deflection less than about 1.12 in) and an increasing positive curvature (i.e. slope becomes more steep as the independent variable [deflection] increases) for a second deflection range (e.g., deflection greater than about 1.12 in). Though not to be bound by theory, it is understood, because the load-deflection curves for a typical coil spring and a foam layer differ, the compressive behavior of mattress innercores incorporating coil springs may differ from the compressive behavior of mattress innercores incorporating foam layers.

Figure 3:
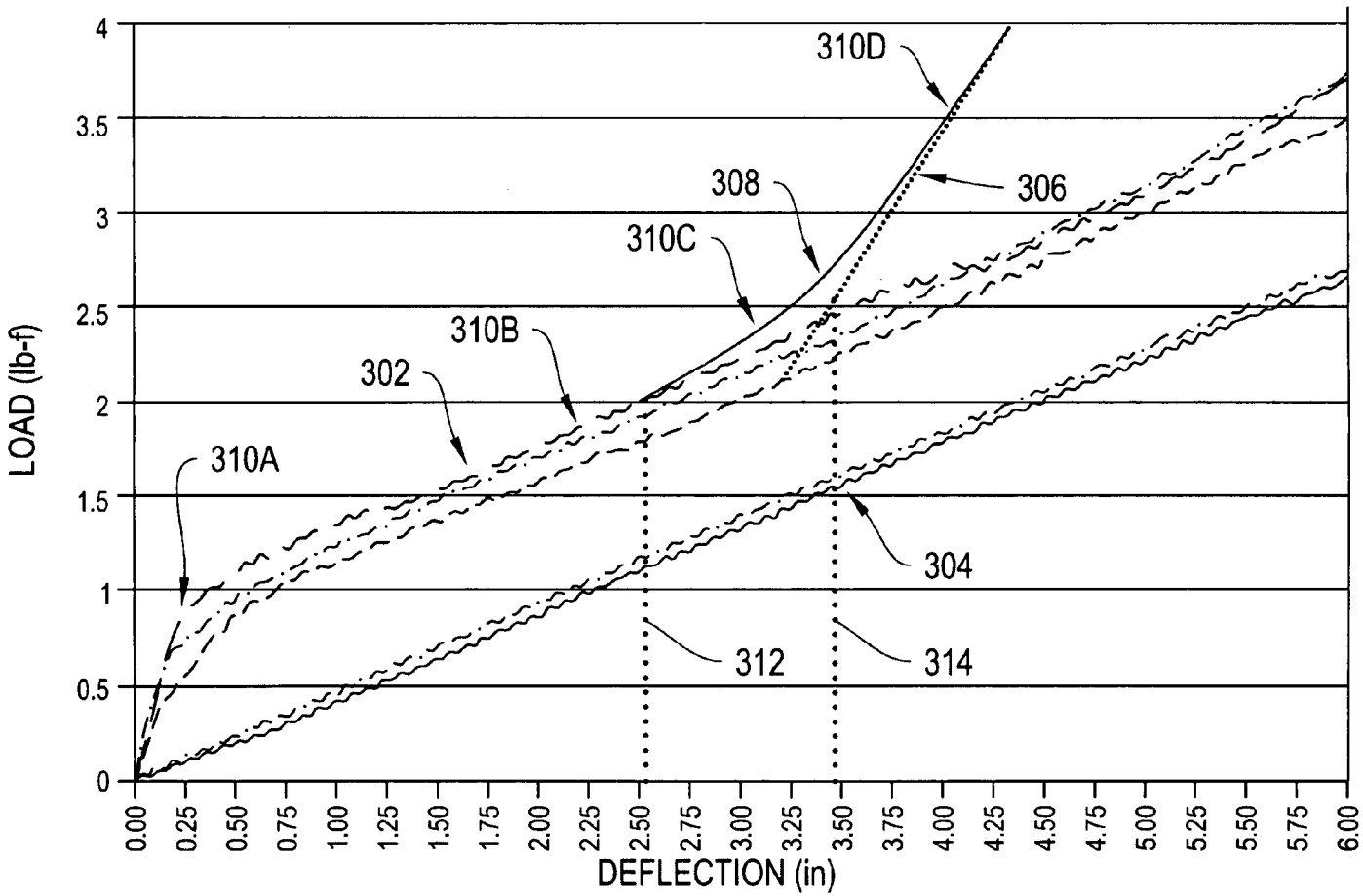
FIG. 3 depicts a graph comparing the compressive behavior of an example encased spring and an example open coil spring, according to an illustrative embodiment of the invention.

Encased springs may be used to approximate the compressive behavior of a foam layer. An encased spring is a spring that is covered with a fabric material so that one encased spring may be connected or glued to another encased spring such that when one encased spring is compressed an adjacent encased spring is not necessarily compressed. Encased springs are useful in bedding applications to prevent motion transfer so that the movement of one sleeping partner will not disturb the sleep of a second sleeping partner. The different types of encased springs may differ in wire pitch, coil diameter, wire material, and/or coil shape, resulting in differing load-deflection characteristics. FIG. 3 depicts a graph comparing the compressive behavior of pre-compressed encased springs and open springs, as well as an embodiment of how springs may be used to approximate foam compression behavior of one particular type of foam having a certain thickness. Although, again, not to be bound by theory, but it is understood that the thickness of the foam inner core effects the deflection dynamics of that inner core. For example, if the thickness of a foam core is increased such that more of the same type of foam is used to build a thicker block, it is expected that the deflection response will be effected, typically by causing the amount of deflection measured to occur at higher loads as compared to a thinner block, therefore extending the measured response curve. Curves 302 are examples of load-deflection curves for pre-compressed encased springs, whereas curves 304 are examples of load-deflection curves for open springs. Both sets of curves are linear for some portion of the deflection range. The open springs are linear throughout the entire deflection range, whereas the pre-compressed encased springs display nonlinear behavior near low deflections (e.g., less than 0.5 or 0.75 inches) and linear behavior for higher deflections (greater than 0.5 or 0.75 inches). Encased springs may display nonlinear behavior near low deflection if they are manufactured as pre-compressed springs. In other words, a spring may be compressed to some degree before it is sealed within the fabric covering. The fabric covering may be made of tough material. The fabric covering may then prevent the spring from fully uncompressing, and in this situation, the encased spring will display a load-deflection curve similar to curve 302. This initial nonlinear behavior of a pre-compressed encased spring may be used to approximate the negative curvature portion of the load-deflection behavior of a foam core, for example by using a spring assembly including pre-compressed encased springs.

Specifically, FIG. 3 depicts a graph of several deflection curves. The x-axis presents deflection in inches, the y-axis depicts load in lb-force. The deflection on the x-axis measures the number of inches a spring or spring assembly was compressed in response to the downwardly applied load. As noted above, three curves 302 are shown depicting the deflection curves of three encased springs. Curves 304 and 306 depict the linear deflection response of two spring coils.

For the three curves 302, each has a portion of the curve 310A that has a steep substantially linear deflection response. The curves then transition to a less steep linear response as shown by the section 310B of the curve. The response curve 308 illustrates the increasingly steeper response slope arising from the combined effect of the spring response 302 with the steep spring response 306. The positive curvature portion of the load-deflection behavior or a foam layer may be approximated by including a second type of spring, with spring characteristics represented by curve 306. The second type of spring may be an open spring coil or an encased spring that is not pre-compressed, which has a linear spring characteristic or load-deflection curve. The deflection offset of the spring characteristic of the second type of spring may be accomplished by using a spring shorter than the surrounding encased springs, as will be discussed below. The height of the second spring was selected as a function of where the inflection point was to occur in the response curve. For example, in FIG. 3, the larger first coil is approximately 6.00 inches in encased height. Deflection, as recorded along the x-axis in inches, as illustrated in FIG. 3 occurs as a function of the spring rate of this larger encased coil until about 3.5 inches of deflection, at which point the deflection response curve 302 is shown to transition. Specifically, between about 3.25 and 3.5 inches of deflection, the curve 302 transitions into response curve 308 under the effect of the spring response 306 that drives the response in the later part of the curve 310D. As will be described below with reference to FIG. 5, the response curve 308 arises from the combined effects of the larger encased spring with the smaller spring. As illustrated, the height of the smaller spring may be selected to begin having an effect at about 2.50 inches of deflection, where as shown by dotted line 312, the curve 308 begins to lift away from curve 302. Thus, the height of the shorter spring may be selected as a function of the desired inflection point, at which point curve 308 begins to deviate from curve 302. Thus, for a 6.00 inch larger coil, the smaller coil may be 3.5 inches, so that its effect does not begin until the illustrate 2.5 inches of deflection. By about 3.5 inches of deflection, the curve 308, as indicated by dotted line 314, begins to become substantially parallel to curve 306, becoming effectively parallel in portion 310D. If the response curve of a thicker foam core was to be modeled, the height of the smaller coil could be lower, pushing the effect further down the x-axis toward larger deflections. Alternatively, a thinner foam block may likely require a model that has a second spring with a height greater than that suggested by curve 302. In this way, the "larger" smaller spring exerts its effect at a lower deflection point, modeling a thinner foam block that has an inflection point that occurs under a lighter load. The addition of the second type of spring to the spring assembly may alter the aggregate spring characteristics of the spring assembly, resulting in positive curvature and a steeper load-deflection characteristic, as shown by curve 308.

In some embodiments, the second type of spring may be an asymmetrical spring. Asymmetrical springs include portions having linear and non-linear spring rates. In one example, an asymmetrical spring includes an upper conical portion and lower cylindrical portion. Such an arrangement allows non-linear compression without causing a substantial compression of the coil springs. Examples of asymmetrical springs may be found in commonly-owned U.S. patent application Ser. No. 11/978,869, entitled "Asymmetrical combined cylindrical and conical springs", the entire contents of which are incorporated herein by reference.

Figure 4:
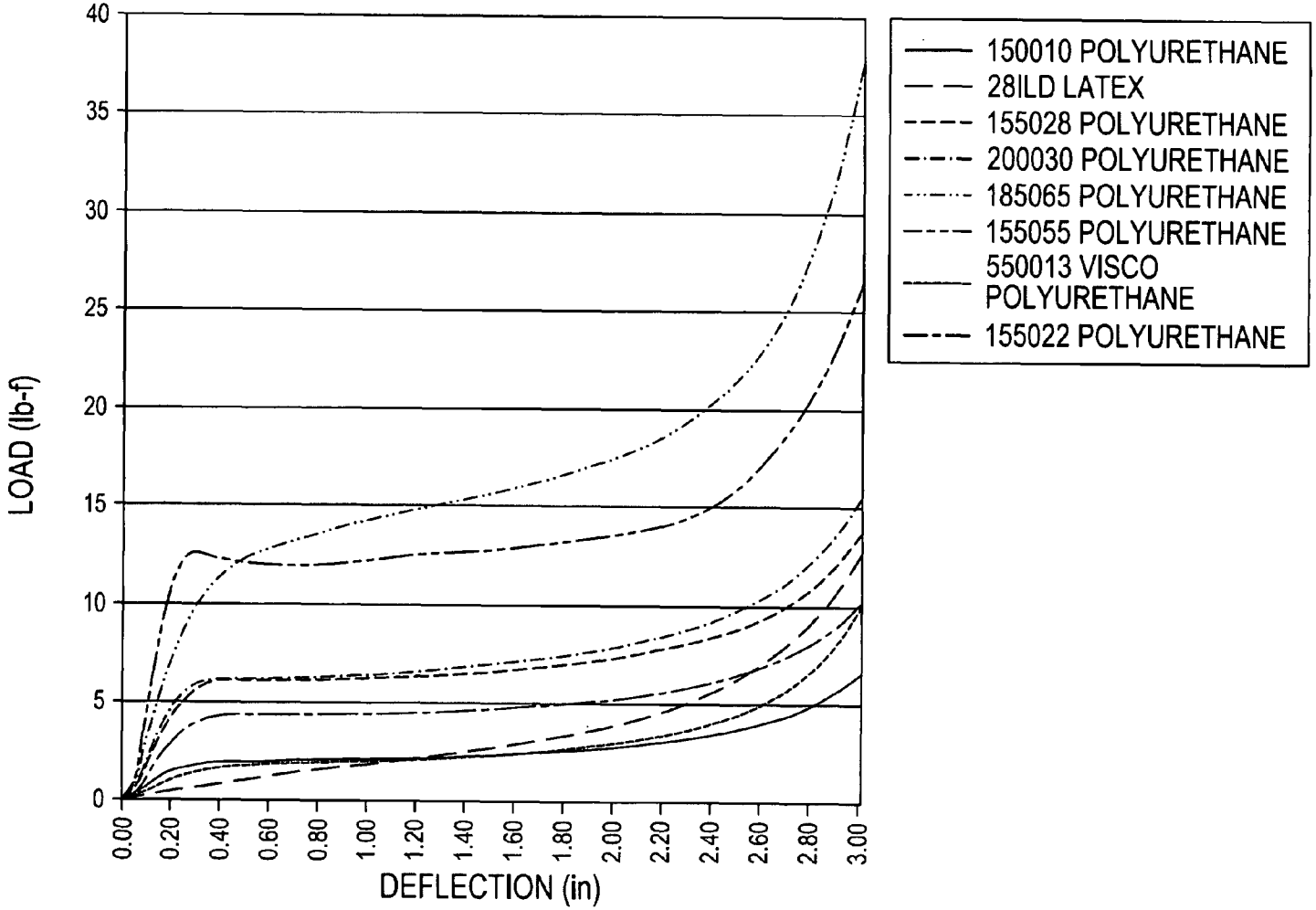
FIG. 4 depicts a graph comparing the compressive behavior of different types of foam.

Various parameters of the aggregate spring characteristics may be modified by varying the parameters of the constituent springs. For example, the position and shape of the curve at the portion of the curve indicated by 310A may be modified by changing the pre-compression characteristics of the pre-compressed encased springs. The slope of the curve at 310B may depend on the spring characteristics of the pre-compressed encased springs, and may be modified by changing spring parameters, such as wire diameter, coil diameter, wire pitch, and wire material. Similarly, the slope of the curve at 310D may depend on the spring characteristics of the second type of spring, and may be modified by changing spring parameters. The location and shape of the curve at 310C may be modified by changing the spring characteristics of the pre-compressed encased springs, the second type of spring, as well as the height of the second type of spring, which will be discussed below. Generally, the spring characteristics may be modified as desired without departing from the scope of the invention. For example, spring characteristics may be modified to substantially mimic characteristics of one of several different types of foam. FIG. 4 depicts load-deflection characteristics of several different types of foam. In certain embodiments, springs and spring parameters may be selected and/or modified to generate spring assemblies having load-deflection characteristics that may be similar to one or more of the foam load-deflection curves depicted in FIG. 4.

Figure 5:
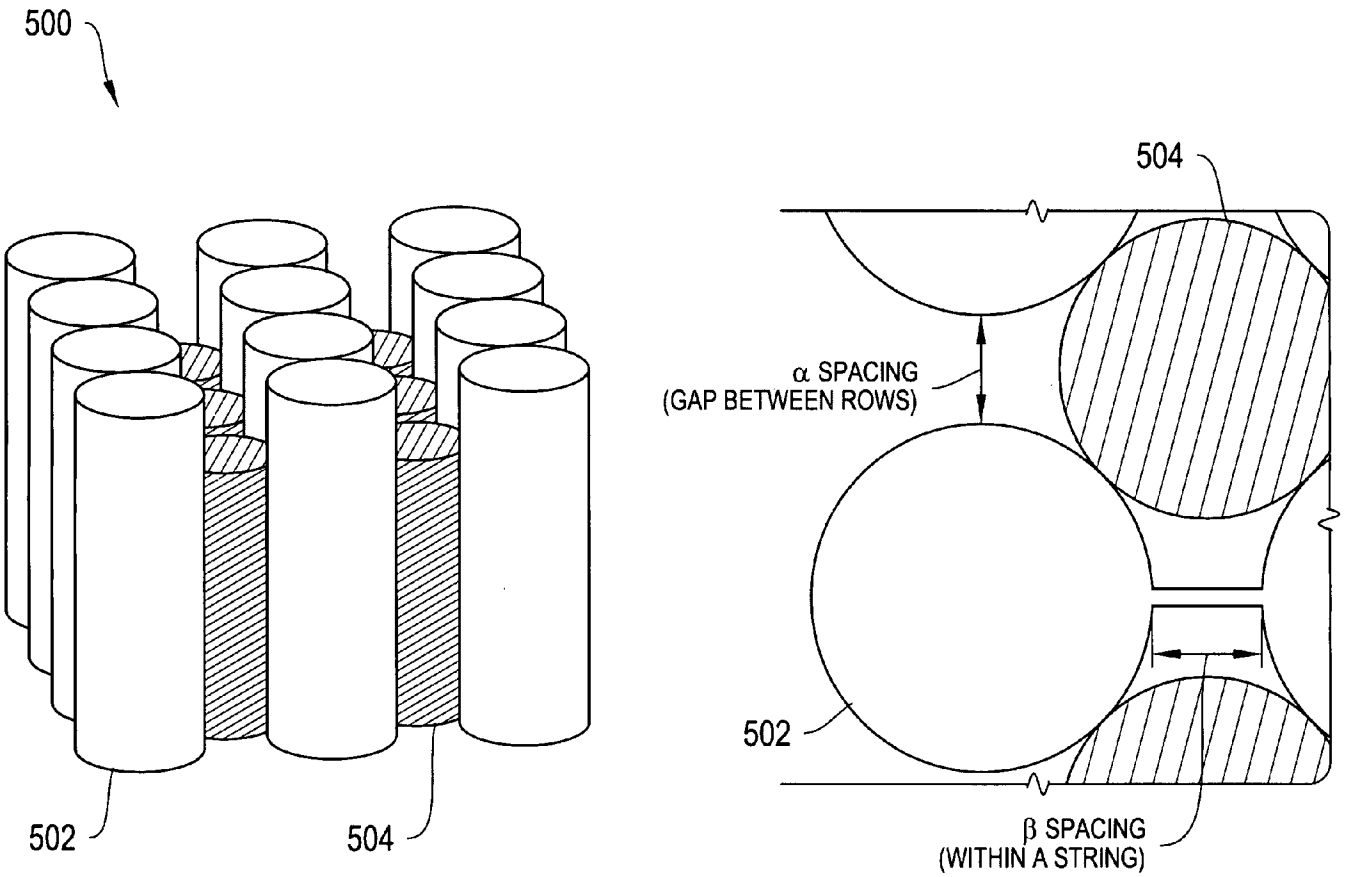
FIG. 5 depicts a spring array that may be configured to mimic the compressive behavior of foam, according to an illustrative embodiment of the invention.

FIG. 5 depicts an illustrative spring array 500 that may be configured to mimic the compressive behavior of foam, according to an illustrative embodiment of the invention. Spring array 500 includes springs 502 of a first type and springs 504 of a second type, which is shorter than first spring type 502. Springs 504 may also have a steeper spring characteristic (e.g. be stiffer) than springs 502. In one example, springs 502 are pre-compressed encased spring coils. The height of pre-compressed encased spring coils may determine the overall height of spring array 500. When the spring array 500 is first compressed, springs 502 will begin to compress first, because they are taller. This provides the initial nonlinear compressive behavior shown in portion 310A of FIG. 3. As the array 500 and springs 502 continue to be compressed, but before springs 504 have begun to compress, the array compressive behavior may eventually become substantially linear, as shown in portion 301B of FIG. 3. When the compression of the array 500 becomes large enough such that the stiffer and shorter springs 504 also begin to compress, the aggregate spring characteristics of the array 500 becomes a combination of the spring characteristics of springs 502 and 504, resulting in the nonlinear transition region shown in portion 310C of FIG. 3. At this point it is understood that the amount of the deflection of the sleeping surface is sufficient to have the sleeping surface contact the top of the shorter spring 504, causing the inflection shown in Section 310C of FIG. 3. As the array 500 continues to compress, the aggregate spring characteristics, now a combination of the spring characteristics of springs 502 and 504, may once again become linear, as shown in portion 310D of FIG. 3. In some embodiments, the aggregate spring characteristics of spring array 500 may be modified by varying the gap spacing between rows of springs and/or the gap spacing between coils within a spring. In some embodiments, springs 504 may be a inches shorter than springs 502, such that a represents about 50% of the height of the modeled foam although the actual amount depends on the foam characteristics, and other heights may be appropriate and can range from for example 40% to 60% of the height of the modeled foam. For example, if the modeled foam has a height of 4", springs 504 are 2" shorter than springs 502.

Figure 6A:
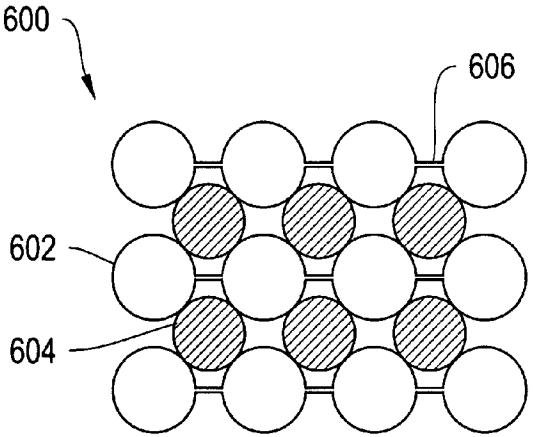
FIGS. 6A-8C depict spring arrays configured to mimic the compressive behavior of foam, according to illustrative embodiments of the invention.
Figure 6B:
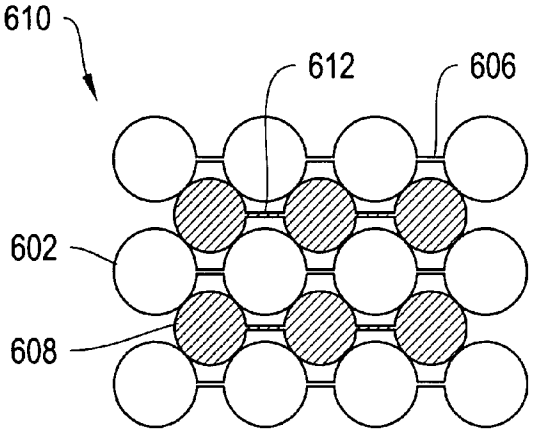
Figure 6C:
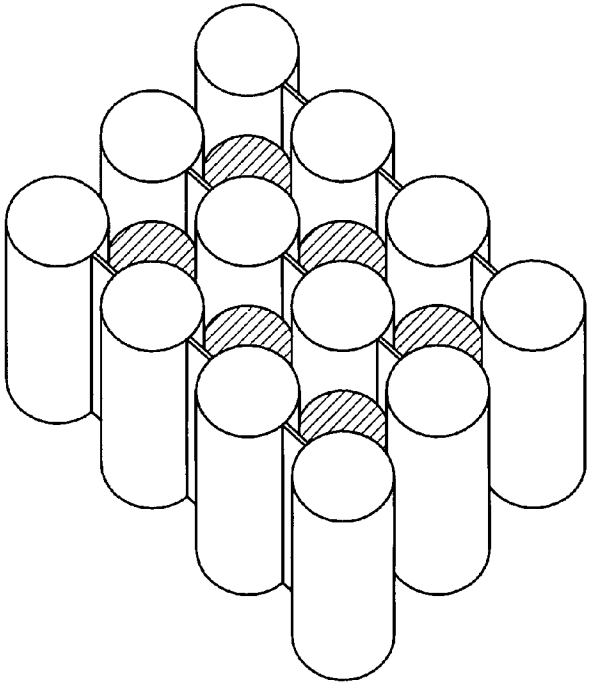

FIGS. 6A-6C depict a spring array configuration according to an illustrative embodiment of the invention. Spring array 600 includes springs 602 of a first type and springs 604 of a second type arranged in an array. In some embodiments, springs 602 may be pre-compressed encased springs, and springs 604 may be uncompressed springs that are shorter and stiffer than springs 602. Springs 602 may be in the form of one or more springs of encased springs, each encased spring attached to another spring in the same row or spring via one or more members 606. Member 606 is only shown for the first row or spring of springs 602, but it should be understood that other rows or springs of springs 602 may also be linked by similar members. In certain embodiments, springs 604 may also be encased (and, optionally partially compressed) springs linked by similar members. In this embodiment, each individual spring is separated horizontally from other springs of the same type by a gap, but optionally connected by a web member, such as the web member 612 shown in FIG. 6B for 610.

Figure 7A:
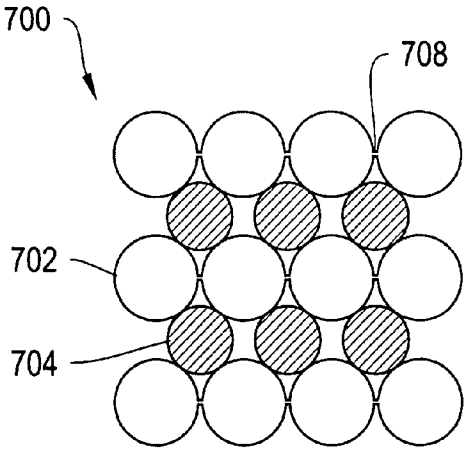
Figure 7B:
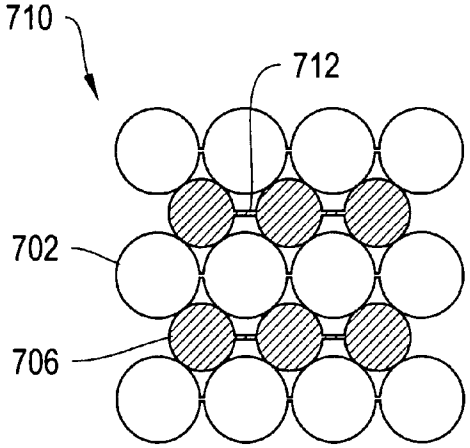
Figure 7C:
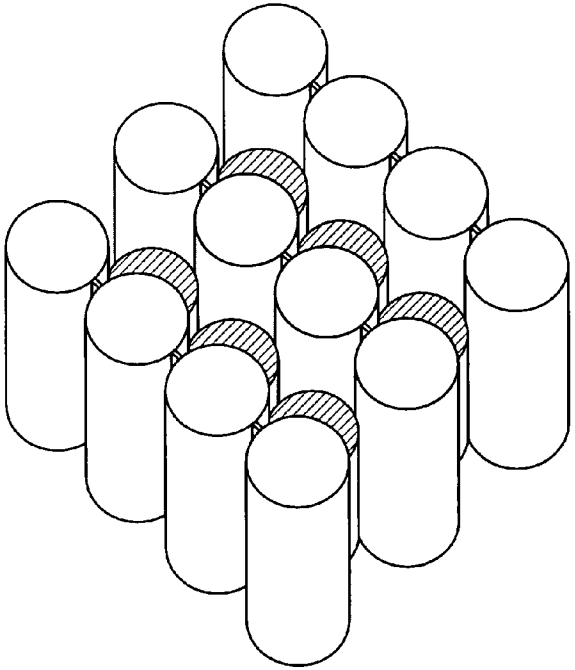

FIGS. 7A-7C depict a spring array configuration according to a second illustrative embodiment. Spring array 700 includes large springs 702 that are encased and optionally compressed and springs 704 that are shorter arranged in an array. FIGS. 7A and 7B illustrate two slightly different embodiments where the shorter springs 706 in array 710 of FIG. 7B has webbing 712 between the springs, and array 700 of FIG. 7A lacks webbing between the shorter springs 704. Typically, the connected springs 706 will be encased springs produced as a string of encased coils. Both embodiments 700 and 710 illustrate a closer packing of springs than the embodiments 600 and 610 of FIGS. 6A and 6B respectively. Different coil density, coils per unit area, will effect coil count and the pitch between coils. The coil density selected will depend upon the application and selected mattress characteristics, as well as the desired diameter of the large and small coils in the array. Those of skill in the art may select the appropriate coil density and the systems and methods described herein do not rely on or require any particular density.

Springs 702 may be pre-compressed encased springs and springs 704 may be uncompressed springs that are shorter and stiffer than springs 702. Similar to spring arrays 600 and 610 shown in FIGS. 6A-6C, springs 702 may be in the form of one or more springs of encased springs, each encased spring attached to at least one other spring in the same row or spring via one or more members 708. In certain embodiments, springs 704 may also be encased (and, optionally partially compressed) springs linked by similar members. However, in this configuration, members 708 may be relatively smaller. As with spring array 600, other rows or strings of springs 702 or 704 may be linked by members (not shown). However, in this embodiment, while each spring 704 may be separated from other springs of the same type by a gap, each spring 702 may be directly adjacent to at least one other spring of the same type in the same row or and may be separated from other springs of the same type in a different horizontal direction by a gap. Spring arrays 700 and 710 may be suitable configurations to substantially reduce waste and substantially increase coil density, as well as ease of assembly. Spring arrays 700 and 710 may further prevent coil lean that may otherwise occur in wider, looser encasements of other spring array embodiments.

Figure 8A:
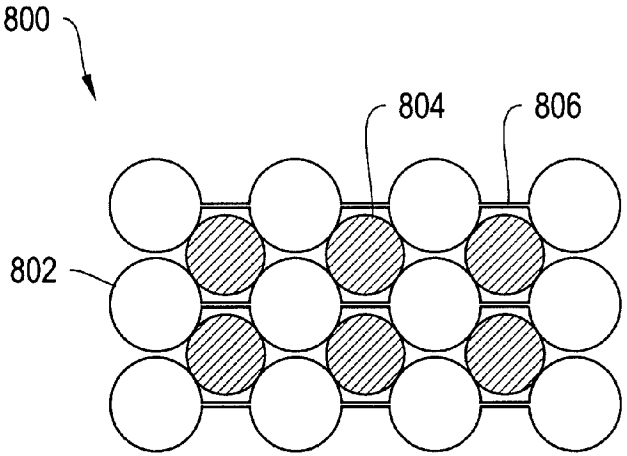
Figure 8B:
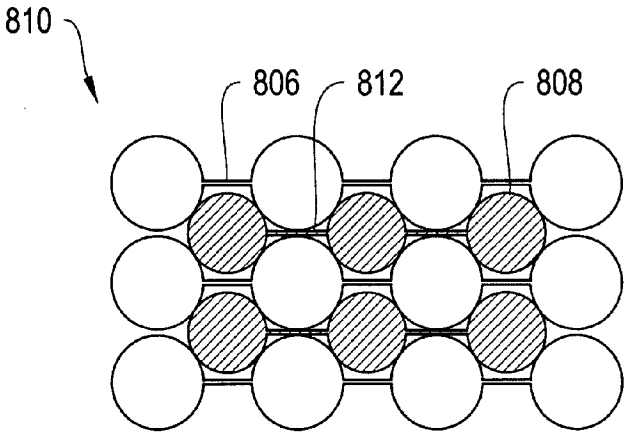
Figure 8C:
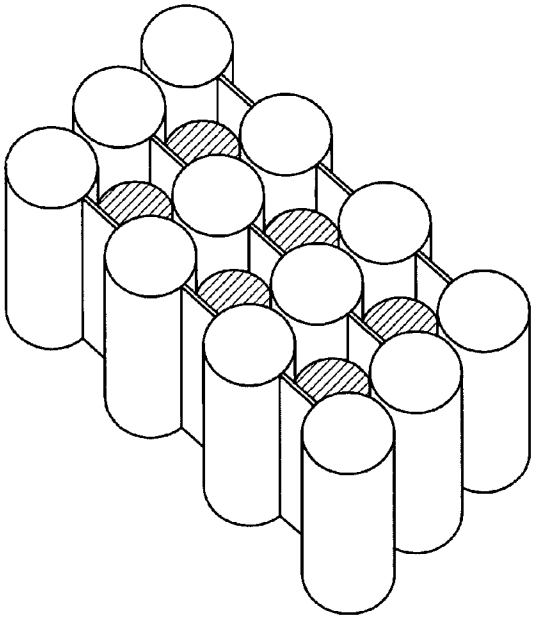

FIGS. 8A-8C depict a spring array configuration according to a third illustrative embodiment. Spring arrays 800 and 810 include springs 802 of a first type and springs 804 or 808, respectively, of a second type arranged in an array. In some embodiments, springs 802 may be pre-compressed encased springs and springs 804 or 808 may be uncompressed springs that are shorter and stiffer than springs 802. Similar to the spring arrays shown in FIGS. 6 and 7, springs 802 may be in the form of one or more spring of encased springs, each encased spring attached to at least one other spring in the same row or spring via one or more members 806. In certain embodiments, springs 804 and 808 may also be encased (and, optionally partially compressed) springs and as shown in FIG. 8B linked by similar members. In the illustrated configuration, springs 802 are separated from other springs in the same spring or row by a gap, but are adjacent to springs of the same type in a different spring or row, whereas springs 804 are separated from other springs of the same type by a gap.

While the depicted embodiments only show two different types of springs, it will be understood that any number of different types of encased springs or springs may be used to construct the array. For example, larger and smaller springs may be encased and placed next to each other in a single row, so that a single row has both large and small springs arranged in an alternating fashion. Similarly, the individual springs may form offset rows instead of the straight rows depicted so that similar coils are arranged along diagonal lines. Moreover, while FIGS. 5-8 depict arrays with different springs across the length and width of the array, it will be understood that the arrays may also be stacked upon each other to provide a multi-layer stack of spring arrays, and that spring types and configurations may vary between layers. Spring arrays may be constructed to provide aggregate spring characteristics with additional linear and nonlinear portions beyond those shown in FIGS. 2-4. Finally, while these embodiments describe encased springs, any type of spring providing a nonlinear load-deflection response may be used and is within the scope of the contemplated inventions.

Figure 9C:
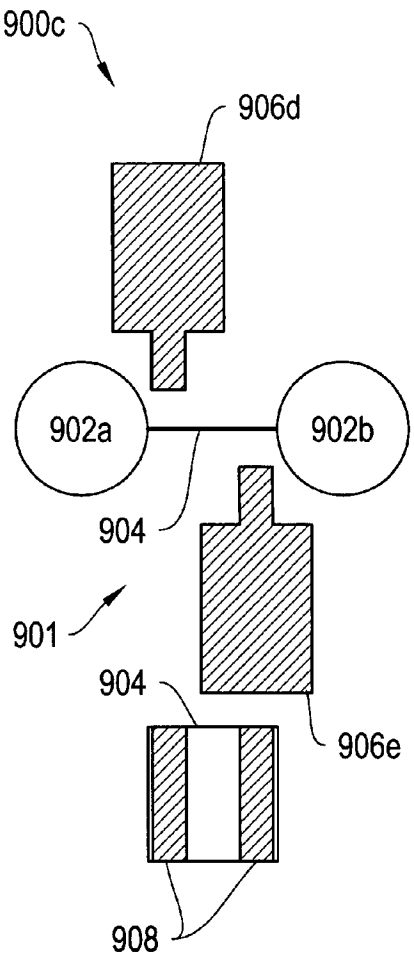
FIGS. 9A-C depict portions of systems for manufacturing spring arrays configured to mimic the compressive behavior of foam, according to illustrative embodiments of the invention.
Figure 9B:
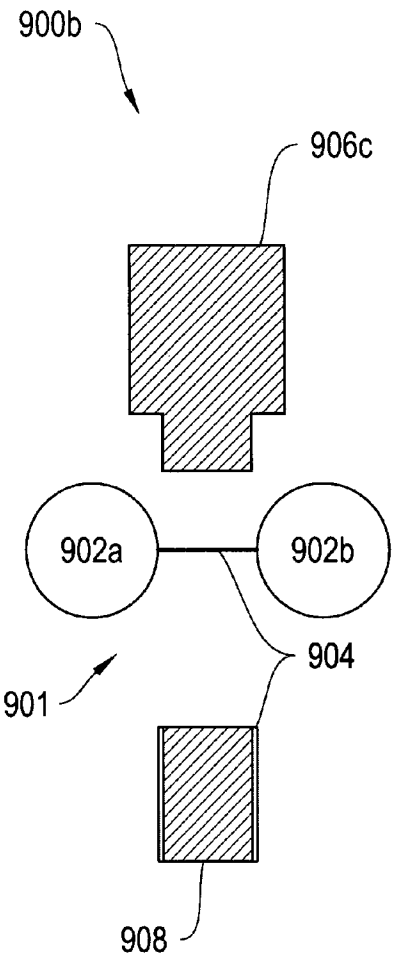
Figure 9A:
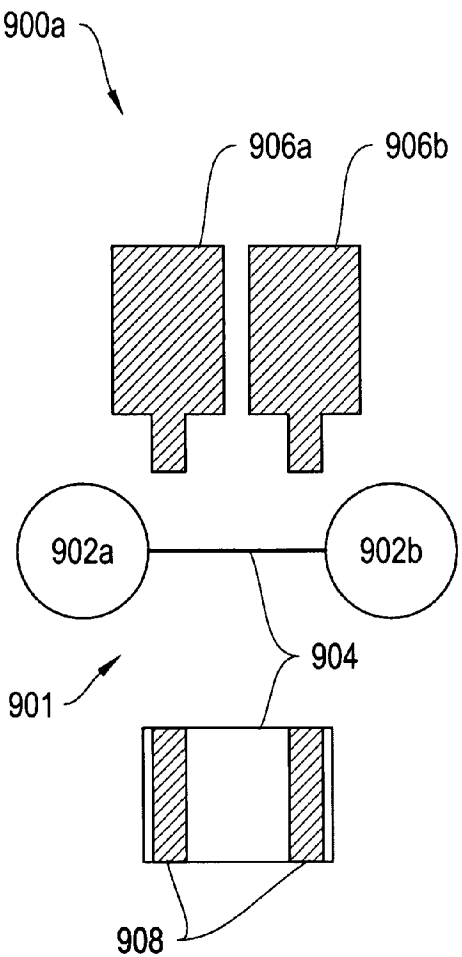

FIG. 9A-C depict portions of systems for manufacturing spring arrays configured to mimic the compressive behavior of foam. System portions 900*a*, 900*b*, and 900*c* may be configured to form strings of encased spring coils 901 with encased coils 902*a* and 902*b* and at least one connecting member 904, which may comprise fabric. In some embodiments, strings 901 may be manufactured by encasing spring coils in a single piece of fabric that forms a receptacle for each spring and then is sealed after the spring is inserted to prevent the coil from escaping or from shifting along the spring of coils. In some embodiments, the spring may be pre-compressed before the receptacle is sealed. To prevent the coil from shifting along the fabric member of the spring and to provide a gap in the spring between two coils, the connecting member 904 may be sealed at one or more locations.

FIG. 9A depicts system portion 900*a* for sealing connecting member 904 according to one exemplary practice. System portion 900*a* includes two ultrasonic welders 906*a* and 906*b* for sealing connecting member 904. The ultrasonic welders 906*a* and 906*b* may be positioned on the same side of the connecting member 904, and may seal the connecting member at locations 908 to prevent coils 902*a* and 902*b* from escaping, as well as to provide a gap between coils 902*a* and 902*b*. In some embodiments, the spacing between welders 906*a* and 906*b* may be variable, in order to vary the size of the gap.

FIG. 9B depicts system portion 900*b* for sealing connecting member 904 according to another illustrative practice.

System portion 900*b* includes an ultrasonic welder 906*c* for sealing connecting member 904 at location 908 to prevent coils 902*a* and 902*b* from escaping, as well as to provide a gap between coils 902*a* and 902*b*.

FIG. 9C depicts system portion 900*c* for sealing connecting member 904 according to yet another illustrative practice. System portion 900*c* includes two ultrasonic welders 906*d* and 906*e* for sealing connecting member 904. The ultrasonic welders 906*a* and 906*b* may be positioned on different sides of the connecting member 904, and May seal the connecting member at locations 908 to prevent coils 902*a* and 902*b* from escaping, as well as to provide a gap between coils 902*a* and 902*b*. In some embodiments, the spacing between welders 906*d* and 906*e* may be variable, to vary the size of the gap. In particular, the welder arrangement of system portion 900*c* may allow the formation of gaps smaller than the welder arrangement in system portion 900*a*.

While FIGS. 9A and 9C depict two welders for creating two seals 908 in connecting member 904, in other embodiments, a single welder may be used for creating two seals, simply by moving either the welder or the coil spring. While the illustrative embodiments in FIGS. 9A-C use ultrasonic welders, any other suitable method for sealing connecting member 904 may be used, such as stitching, adhesives, or any other means of fastening, adhesion, or sealing.

Figure 10:
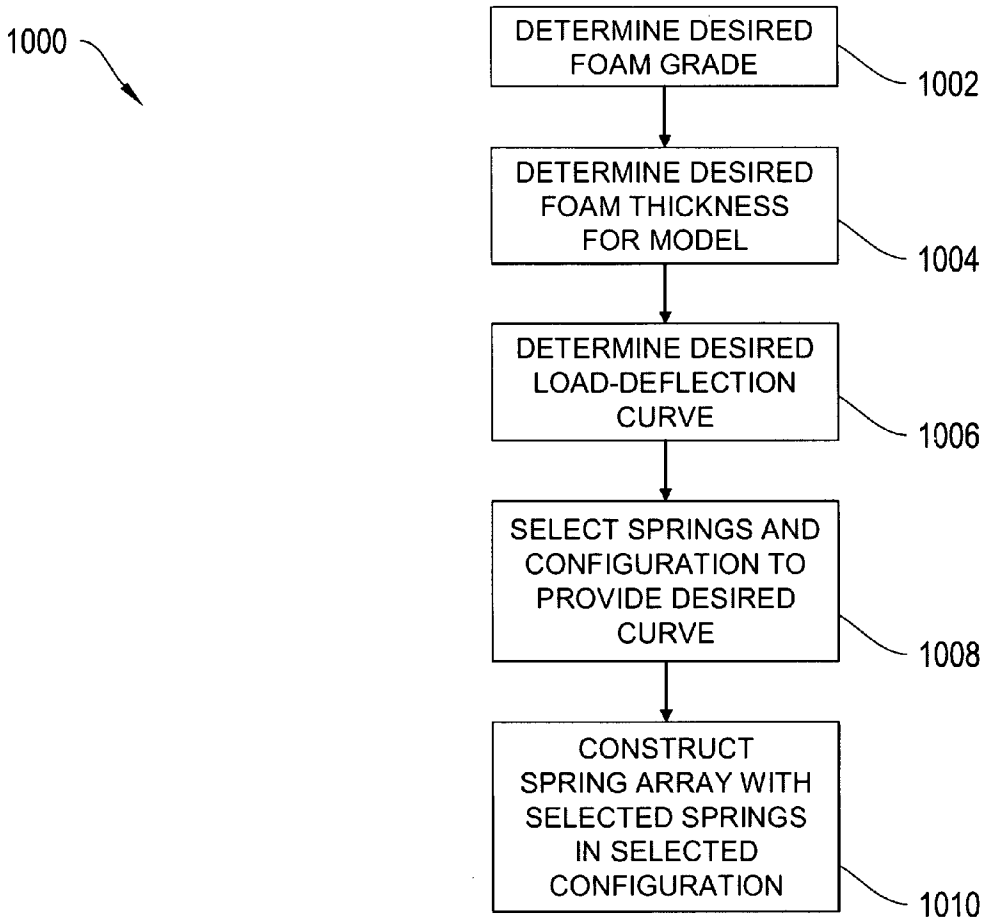
FIG. 10 is a flowchart depicting an illustrative process for manufacturing a spring assembly with springs configured to provide foam-like compressive behavior.

FIG. 10 is a flowchart depicting one process 1000 for manufacturing a spring assembly with springs configured to provide foam-like compressive behavior. Specifically, FIG. 10 depicts a process 1000 that sets out certain steps for manufacturing an assembly of springs that will have a deflection response that mimics the load deflection response of a selected foam of selected grade and characteristic. The process 1000 begins in step 1002 wherein a desired foam grade is selected. Typically, the foam grade is a grade of polyurethane foam with a cell structure suitable for use as a mattress foam core, or the foam core of another type of furniture. The process 1000 proceeds to step 1004 wherein the thickness of the foam core is selected. Once the process 1000 has selected the grade and thickness of the foam, the model of the foam core may be made. To that end, the process proceeds to step 1006. In step 1006, the desired load-deflection curve is determined. Typically, a series of deflection response measurements are taken to build a model similar to the model depicted in FIG. 2 and shown by curve 202. In step 1008, encased, open, or other types of springs are selected, along with a spring configuration, to provide the desired load-deflection curve. As shown with reference to FIG. 3, the plural response characteristics of the foam core may be matched, in a piece meal fashion, to response characteristics provided by a plurality of springs, selecting spring constants and spring heights that achieve the desired response curve and inflection point. Finally, the spring array is constructed with the selected springs in the selected configuration in step 1010.

Figure 11:
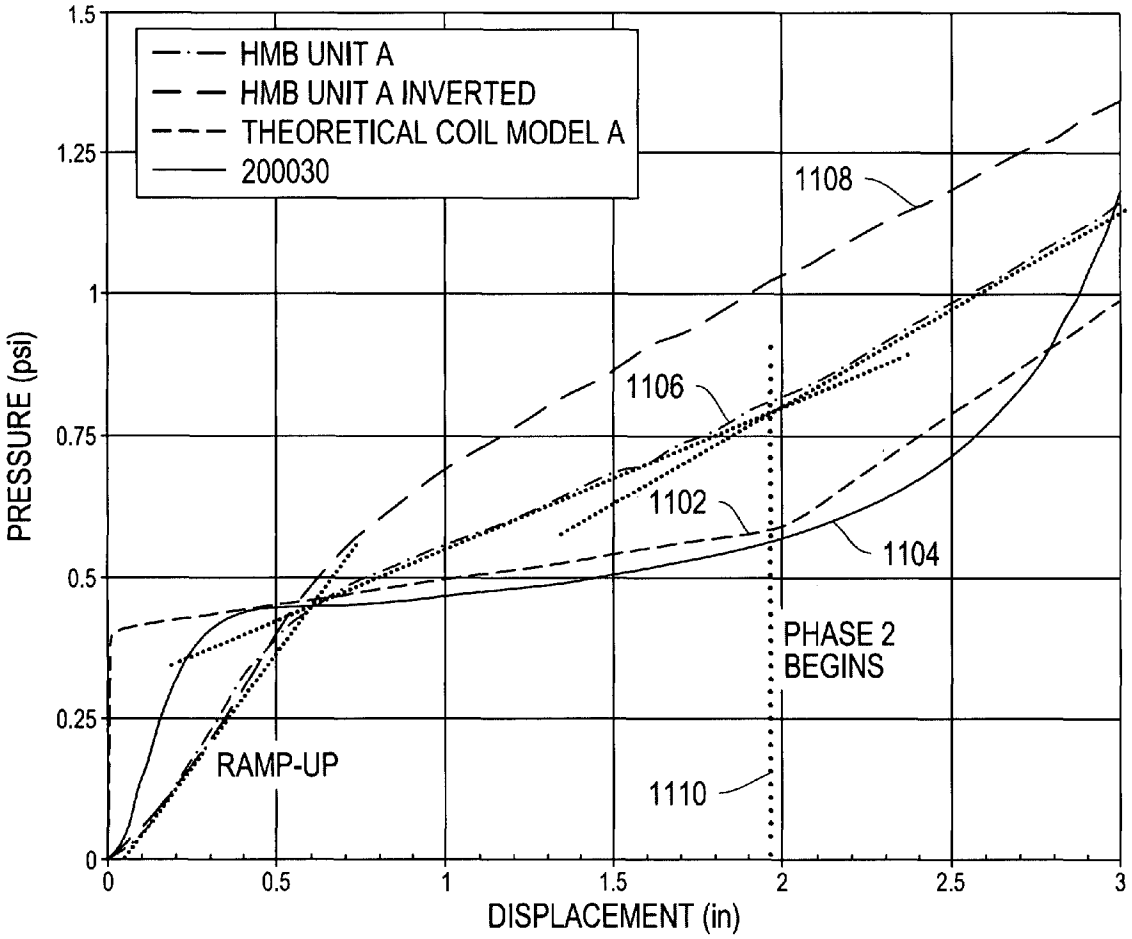
FIG. 11 depicts the displacement response curves of several coil spring assemblies.

FIG. 11 depicts a load-deflection or pressure-displacement curve for an illustrative embodiment, Model A, of a spring assembly with alternating rows of two types of springs configured to provide foam-like compressive behavior. According to step 1006 (FIG. 10), the load-deflection curve of a block of foam of a select grade and thickness are chosen, and for this example a 20 lb 30ILD polyurethane foam (hereforth referred to as "200030") was selected. In step 1008 (FIG. 10), the spring rates of the two types of springs that will be used in the spring assembly are derived from the 200030 response curve. As can be seen from Table 1, the two types of springs include a larger spring of 12.51 inches of free length and a shorter spring of 6 inches of free length, Type 1 and Type 2 respectively. These two types of springs may be arranged into an array as discussed with reference to FIGS. 5-8, and for example may correspond to spring 702 and 706 of spring assembly 710 of FIG. 7B In deriving the parameters of the two types of springs, the below equation may be used:

$$k=(G*d^4)/(8*N*D^3)$$

given, k=Spring Rate (lbf/in.)

G=Modulus of Elasticity [$30\times10^6$ psi for Steel Music Wire]

d=Wire Diameter (in)

N=Number of Active Coil Turns

D=Mean Coil Diameter (in.)

The derived specifications for the two types of springs, Type 1 and Type 2, (for example springs 702 and 706) are shown in Table 1. Type 1 springs are encased and pre-compressed, while Type 2 springs are not pre-compressed. The derived specification values may vary in the range of +/−15%.

TABLE 1

Specifications for Model A

| | | Type 1 | Type 2 |
|---|---|---|---|
| Number of active convolutions | N | 5.75 | 2.531 |
| Free Length (in.) | FL | 12.51 | 6 |
| Height of encasement (in.) | h | 8 | 6 |
| Wire diameter (in.) | d | 0.088 | 0.088 |
| Outside Coil Diameter (in.) | OD | 2.58 | 2.25 |
| Mean Coil Diameter [=OD − d] (in.) | D | 2.49 | 2.16 |
| Spring Rate (lbf/in) | k | 0.946 | 3.282 |
| Pre-Compression [=FL − h] (in) | $F_0$ | 4.51 | 0 |
| Pre-Load [=$F_0$ * k] (lbf) | $P_0$ | 4.27 | 0 |
| Pitch [=FL/N] (in) | p | 2.18 | 2.37 |

In step 1010 (FIG. 10), the spring assembly is assembled with alternating rows of Type 1 and Type 2 coils, according to configuration of spring array such as spring array 700 (FIG. 7).

To produce the curves depicted in FIG. 11, the spring assembly is tested for firmness by compressing the center of the spring assembly with an 18"×36" platen fitted with a load cell to record the force applied through the compression cycle. Curve 1102 shows the pressure-displacement curve according to the targeted theoretical model for spring assembly Model A. The response curve 1104 for 200030 foam is also plotted as a basis for comparison. While the theoretical model curve 1102 closely resembles the identified 200030 curve 1104, the actual data suggests some differences. Curve 1106 for spring assembly Model A shows very little change in spring rate at 1.8" of compression, which is the line 1110, representing the point of transition from negative curvature to positive curvature. Curve 1108 represents the response when the spring assembly is loaded from the "bottom" side of the assembly, where the ends are flush, that is at the inactive coil. Curve 1108 shows a higher spring rate through transition point 1110.

It may be inferred that the physical assembly of spring coils may inhibit the motion separation required to mimic the foam load-deflection curve across transition point 1110 and theoretical curve 1102. The behavior before transition point 1110, which should theoretically only consist of the response from Type 1 coils, shows that other factors may affect the feedback response. This may be attributed to a phenomenon known as "nesting." During assembly, encased coil springs may be forced together in such a way that one or multiple convolutions in a coil may encroach on a neighboring coil. The pitch of the coils, along with the packed nature of the array, such as array 700, may contribute to this effect. When this occurs, under compression, a coil's convolutions may pull down on the convolutions of a neighboring coil. This "nesting" effect may be accountable for the behavior seen in curve 1106, particularly across transition point 1110. When the assembly is loaded from the top, the Type 2 coils may be compressed throughout the entire compression cycle because they are nesting with Type 1 coils, rather than only beginning compression at 2" of displacement in the unit, as designed. When inverted, these coils may be immediately acted upon, resulting in the increased response shown in curve 1108 and less defined by target curve 1104.

Another factor affecting the spring assembly response may be contributed to edge effects. The test procedure uses an 18"×36" rectangular platen compressing the center of the spring assembly. The platen does not cover the entirety of the spring assembly surface. Since the coils underneath the edges of the platen are still connected to neighboring coils within the same coil string, the neighboring coils may be pulled down by the coils being stressed. This edge effect would skew the data and result in a higher load response.

Figure 12:
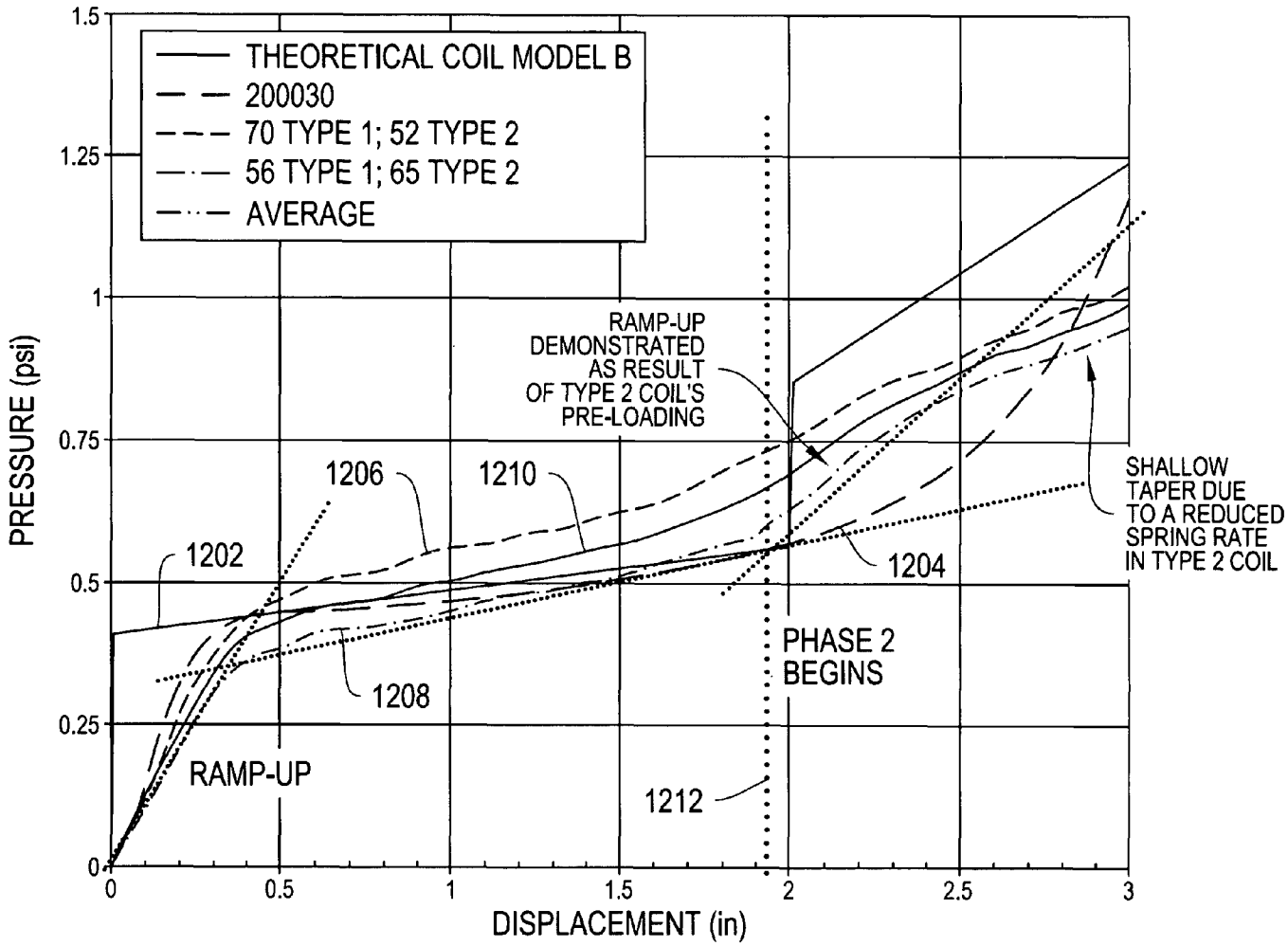
FIG. 12 depicts the displacement response curves of certain alternate spring assemblies.

FIG. 12 depicts a load-deflection or pressure-displacement curve for an illustrative embodiment, Model B, of a spring assembly with springs configured to provide foam-like compressive behavior. Model B is designed to possibly reduce the stiffness of the Type 1 coil from Model A, and increase the pre-load in Type 2 from Model A. The differences may help resist any interference for Type 2 coils from "nesting" with the Type 1 coils. Model B is similarly assembled with alternating rows of Type 3 and Type 4 coils, according to configuration of spring array 700 (FIG. 7). The derived specifications for the two types, Type 3 and Type 4, are shown in Table 2. The derived specification values may vary in the range of +/−15%.

TABLE 2

Specifications for Model B

| | | Type 3 | Type 4 |
|---|---|---|---|
| Number of active convolutions | N | 5.15 | 3.79 |
| Free Length (in.) | FL | 11.14 | 6.5 |
| Height of encasement (in.) | h | 6 | 4 |
| Wire diameter (in.) | d | 0.083 | 0.076 |
| Outside Coil Diameter (in.) | OD | 2.58 | 2.25 |
| Mean Coil Diameter [=OD − d] (in.) | D | 2.49 | 2.17 |
| Spring Rate (lbf/in) | k | 0.83 | 3.282 |
| Pre-Compression [=FL − h] (in) | $F_0$ | 5.14 | 2.5 |
| Pre-Load [=$F_0$ * k] (lbf) | $P_0$ | 4.27 | 3 |
| Pitch [=FL/N] (in) | p | 2.16 | 1.72 |

To produce the curves depicted in FIG. 12, the spring assembly is tested for firmness as described above. To avoid the effect of having the test plates push on edges of springs, the tested spring assembly is kept at dimensions that will allow the spring assemblies to fully fit under the test plates. Curve 1202 shows the pressure-displacement curve according to the theoretical model for spring assembly Model B. The response curve 1204 for 200030 foam is also plotted as a basis for comparison. Curves 1206 and 1208 show two iterations of testing Model B, while curve 1210 shows the average of the two curves. The two iterations are performed and their results averaged in order to possibly eliminate interference from edge effects. Curve 1206 corresponds to testing a spring assembly portion containing 5 rows of 14-coil long Type 3 springs alternating with 4 rows of 13-coil long Type 4 springs. Curve 1208 corresponds to testing a spring assembly portion containing 5 rows of 13-coil long Type 4 springs alternating with 4 rows of 14-coil long Type 1 springs. It may be observed that curves 1206 and 1208 taken separately deviate from the desired curve 1204 for 200030 foam. However, the average curve 1210 strongly follows the desired curve 1204 and may be appropriate for recreating the firmness of a 200030 foam core.

Figure 13A:
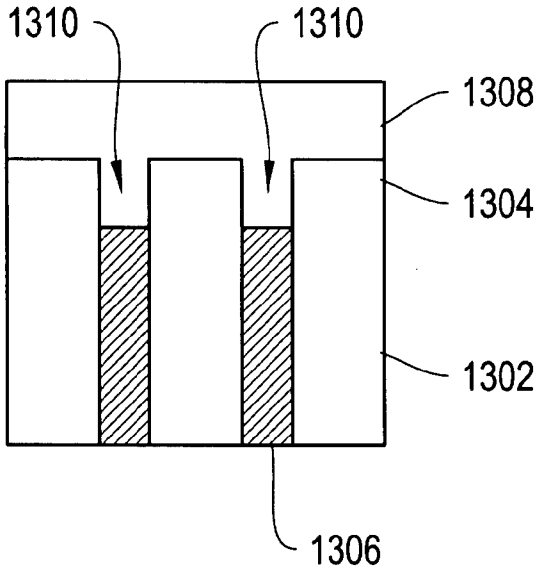
FIGS. 13A-13C depicts a foam pad for covering spring assemblies of the type described herein.
Figure 13B:
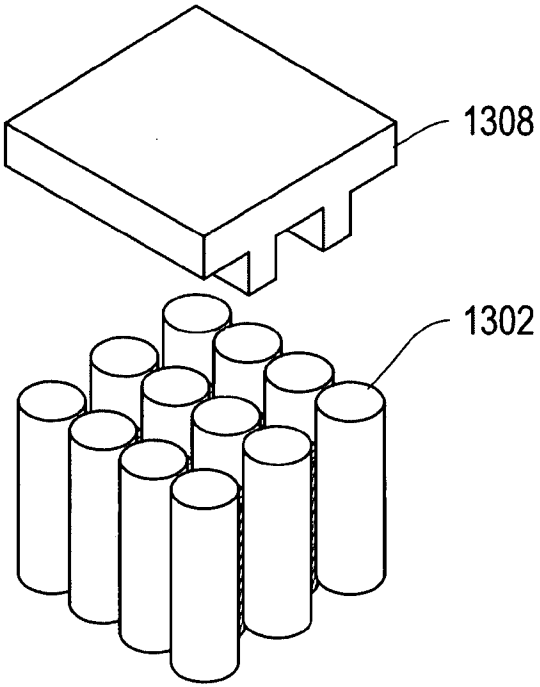
Figure 13C:
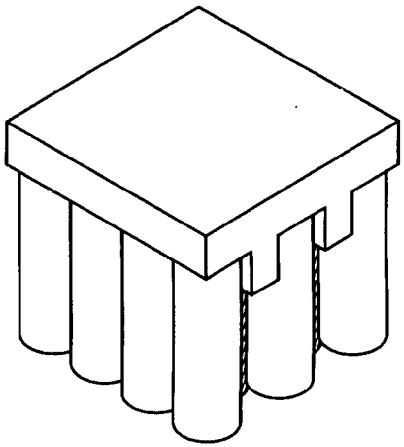

In any case, the spring assemblies may be construed as discussed above and employed as a cushion or mattress spring core. To that end, a foam padding layer may be disposed on top of the spring assembly. One such foam padding layer is depicted in FIGS. 13A-13C. Specifically, FIG. 13A depicts a spring array 1302 and a topper pad 1308. As depicted in FIG. 13A, the spring array 1302 includes springs of different heights and to create a good fit between the foam pad and the spring assembly, the foam pad includes foam protrusions 1310 that will fit in the gaps between the rows of taller springs 1304. The foam pad may be manufactured by the methods described in the commonly-owned patent (U.S. Pat. No. 7,174,613), entitled, "Method for Manufacturing a Foam Core having Channel Cuts," the contents of which is incorporated herein in its entirety. FIGS. 13B and 13C show the topper 1308 being positioned above the array and then fit in place. In an alternate embodiment, the gaps between the taller springs 1304 may be filled with strips of foam that will create a level surface over which a flat foam paid may be seated.

Once the foam padding layer is in place, the upholstery may be applied and the mattress covered. As will be understood by those of skill in the art, the mattress will have a deflection response similar to a foam core mattress, and may, if so modeled, have a region of its deflection response curve that has a slight slope that occurs with the middle section of the deflection response shown in FIG. 12 for curves 1206 and 1208. Though not be bound by theory, this is understood to provide a more consistent firmness across a wide range of applied force, thus allowing users of different weight, to experience a similar level of firmness during a night's sleep.

Variations, modifications, and other implementations of what is described may be employed without departing from the spirit and scope of the invention. More specifically, any of the method and system features described above or incorporated by reference may be combined with any other suitable method or system features disclosed herein or incorporated by reference, and is within the scope of the contemplated inventions. The systems and methods may be embodied in other specific forms without departing from the spirit or essential characteristics thereof. The foregoing embodiments are therefore to be considered in all respects illustrative, rather than limiting of the invention. The teachings of all references cited herein are hereby incorporated by reference in their entirety.

The invention claimed is:

1. A cushion construction having a spring coil assembly and configured to mimic the compression characteristics of foam, comprising a plurality of rows of a first set of encased springs, wherein each spring of the first set of springs is in a partially compressed state within an encasement, and a plurality of rows of a second set of springs, wherein each row of the second set of springs is positioned between the rows of the first set of encased springs, such that the rows of the first set of springs and the rows of the second set of springs are arranged in alternating rows, wherein each spring of the second set of springs is in uncompressed state and has a free length less than an encased height of one or more springs in the first set of encased springs.

2. The cushion construction of claim 1, wherein at least one of the springs in the first set and second set comprise one or more types of spring coils from the group consisting of open spring coils, encased spring coils, conical coils, asymmetrical spring coils or combination thereof.

3. The cushion construction of claim 1, wherein each spring in the first set of encased springs has a free length from about 7.25 to about 13.25 inches.

4. The cushion construction of claim 1, wherein the encased height of each spring in the second set of springs is from about 1 to about 8 inches.

5. The cushion construction of claim 1, wherein the height of the encasement is from about 2 to about 10 inches.

6. The cushion construction of claim 1, wherein a spring rate of the first set of springs is less than a spring rate of the second set of springs.

7. The cushion construction of claim 6, wherein the spring rate of the first set of springs is from about 0.39 lbf/in. to about 2.47 lbf/in, and the spring rate of the second set of springs is from about 2.55 lbf/in. to about 12.36 lbf/in.

8. The cushion construction of claim 1, wherein each spring of the second set of springs is in a partially compressed state and disposed within an encasement.

9. The cushion construction of claim 1, wherein a difference between the free length of the spring in the first set of springs and a length of the encasement determines the amount of compression each spring in the first set of springs undergoes while in the partially compressed state.

10. The cushion construction of claim 1, wherein the alternating rows of the first set and the second set are arranged in an offset manner, such that each row of the second set of springs fits in a gap between two rows of the first set of springs.

11. The cushion construction of claim 1, wherein each spring of the second set of springs is in contact with the encasement surrounding four springs of the first set of springs, and vice versa.

12. The cushion construction of claim 1, wherein the encasement includes a fabric casing.

13. The cushion construction of claim 1, further comprising a padding layer disposed on at least one surface of the spring coil assembly, wherein the padding layer may have variable height or thickness varying along at least one of width and length of a topper pad.

14. The cushion construction of claim 1, further comprising one or more fire-retardant, liquid-resistant, or allergy resistant layers disposed on at least one surface of the spring coil assembly.

15. A method of manufacturing a spring coil assembly, comprising providing a first set of springs and a second set of springs, wherein a free length of the first set of springs is greater than a encased height of the second set of springs, partially compressing the first set of springs and disposing them in an encasement while in the partially compressed state, and arranging the first set of encased springs and the second set of springs in alternating rows, wherein each spring in the second set of springs is in an uncompressed state, wherein the spring coil assembly has non-linear load-deflection characteristics based on one or more parameters of the first set of springs, the second set of springs, amount of compression of the first set of springs, and arrangement of the alternating rows.

* * * * *